US006871433B2

(12) United States Patent
Anza'

(10) Patent No.: US 6,871,433 B2
(45) Date of Patent: Mar. 29, 2005

(54) MULTI-LAYER THREE-DIMENSIONAL DISPLAY

(76) Inventor: Pierfrancesco Anza', Viale delle Milizie, 34, 00192 Roma (IT)

( * ) Notice: Subject to any disclaimer, the term of this patent is extended or adjusted under 35 U.S.C. 154(b) by 0 days.

(21) Appl. No.: 10/182,617

(22) PCT Filed: Jan. 15, 2001

(86) PCT No.: PCT/IT01/00013

§ 371 (c)(1),
(2), (4) Date: Nov. 12, 2002

(87) PCT Pub. No.: WO01/57830

PCT Pub. Date: Aug. 9, 2001

(65) Prior Publication Data

US 2003/0172566 A1 Sep. 18, 2003

(30) Foreign Application Priority Data

Feb. 1, 2000 (IT) ..... RM20000020 U

(51) Int. Cl.[7] ..... G09F 1/08

(52) U.S. Cl. ..... 40/539; 40/124.08; 40/124.19; 446/105; 446/106

(58) Field of Search ..... 40/539, 538, 124.08, 40/124.19, 124.4; 446/105, 106, 108, 109, 115

(56) References Cited

U.S. PATENT DOCUMENTS 772,343 A * 10/1904 Diehl ..... 40/539
1,026,634 A * 5/1912 Stranders ..... 40/539
1,052,187 A * 2/1913 Stranders ..... 40/539
1,194,678 A * 8/1916 Stranders ..... 40/539
1,842,622 A * 1/1932 Einson et al. ..... 40/539
2,203,578 A 6/1940 Podmore
3,829,998 A 8/1974 Flax
4,315,376 A 2/1982 Eichenauer
4,833,802 A * 5/1989 Volkert ..... 40/539
4,885,859 A 12/1989 Gasser
5,317,823 A * 6/1994 Brunt, II ..... 40/539
5,657,562 A * 8/1997 Desormeaux ..... 40/539
5,658,620 A * 8/1997 Ross ..... 40/539

* cited by examiner

*Primary Examiner*—Gary C. Hoge
(74) *Attorney, Agent, or Firm*—Birch, Stewart, Kolasch & Birch, LLP

(57) ABSTRACT

A set (1) for the composition of bi-dimensional images into tri-dimensional form, comprising a panel plurality (2), each panel (21, 22, 23, 24) reproducing a respective bi-dimensional image, and a support unit (3), apt to support the panels so that they are substantially parallel to a same plane, which unit has members (31, 32, 33, 34, 35) rotatably connected one to the other by rotatable connection means (5), to make the set assume a plurality of exhibition configurations and a minimal encumbrance configuration, wherein the panels and the support unit have reversible means of mutual engagement (4) (FIG. 3).

13 Claims, 5 Drawing Sheets

3
4
5
8
31
32
33
34
35
41
81
82
P

MULTI-LAYER THREE-DIMENSIONAL DISPLAY

This application is the national phase under 35 U.S.C. §371 of PCT International Application No. PCT/IT01/00013 which has an International filing date of Jan. 15, 2001, which designated United States of America.

BACKGROUND OF THE INVENTION

1. Field of the Invention

The present invention relates to a set for the composition of bi-dimensional images into tri-dimensional form.

2. Description of the Related Art

In the souvenir field, paper articles are known apt to generate a tri-dimensional image starting from bi-dimensional images such as urban or monument views or the like.

These articles typically comprise a set of panels, each one reproducing one of the above mentioned bi-dimensional images, and a support frame wherein these panels are housed.

In particular, the frame is generally made of a front wall, a rear wall and two side walls. The frame front wall has a wide opening, so that the panels are visible therethrough. The panels, in fact, are placed within the frame so as to be parallel to a same plane, and, in particular, parallel to the front and rear walls of the frame itself.

The frame and the panels are joined at side edges thereof by irreversible joining means, for example by gluing. Thanks to this joining, the panels are kept in their mutual arrangement which enables to reproduce an image having depth, and therefore tri-dimensional, by means of the bi-dimensional images represented on the panels themselves.

By making adjacent walls of the frame rotate one with respect to the other at separating creasings thereof, it is possible to change the panel mutual arrangement and therefore the perspective effect produced. Furthermore, the article may also be brought to a configuration which might be defined of minimal encumbrance, wherein the article itself has substantially plane extension.

The paper articles of the known art hereto described have some important disadvantages.

First of all, these articles enable to generate a limited range of perspective effects. Therefore, the need of having at one's disposal a greater variety of views and perspectives is felt.

Furthermore, these articles provide a reduced interaction with the user. A more active role of the user him/herself in the choice and ideation of the article configurations and, therefore, of the views and perspectives which can be generated with it would be then desirable.

SUMMARY OF THE INVENTION

The technical problem underlying the present invention is to provide a set for the composition of bi-dimensional images in tri-dimensional form enabling to overcome the problems mentioned above with reference to the known art.

This problem is solve by a set for the composition of bi-dimensional images in tri-dimensional form, comprising:

a plurality of panels, each panel of said panel plurality reproducing a respective bi-dimensional image; and a support unit, apt to support the panels of said panel plurality so as they are substantially parallel to a same plane, said support unit having members rotatably connected one to the other by rotatable connection means, to make said set assume a plurality of exhibition configurations, wherein said set has substantially tri-dimensional extension, and a minimal encumbrance configuration, wherein said set has substantially plane extension, wherein the panels of said panel plurality and said support unit have reversible means of mutual engagement.

The present invention provides some important advantages. The main advantage lies in the fact that the presence of the above mentioned reversible means of mutual engagement of the panels and of the support unit allows to obtain a wide range of views and perspectives. In fact, for example, the arrangement of the panels may be changed at will, and one can choose to exhibit only some panels of the panel plurality. This also favours a more active role of the user in the choice of views and/or perspectives to be generated.

BRIEF DESCRIPTION OF THE DRAWINGS

Other advantages, features and application modes of the present invention will be evident from the following detailed description of some embodiments, illustrated by way of example and not for limitative purposes. The Figures of the enclosed drawings will be referred to, wherein.

DETAILED DESCRIPTION

Figure 1:
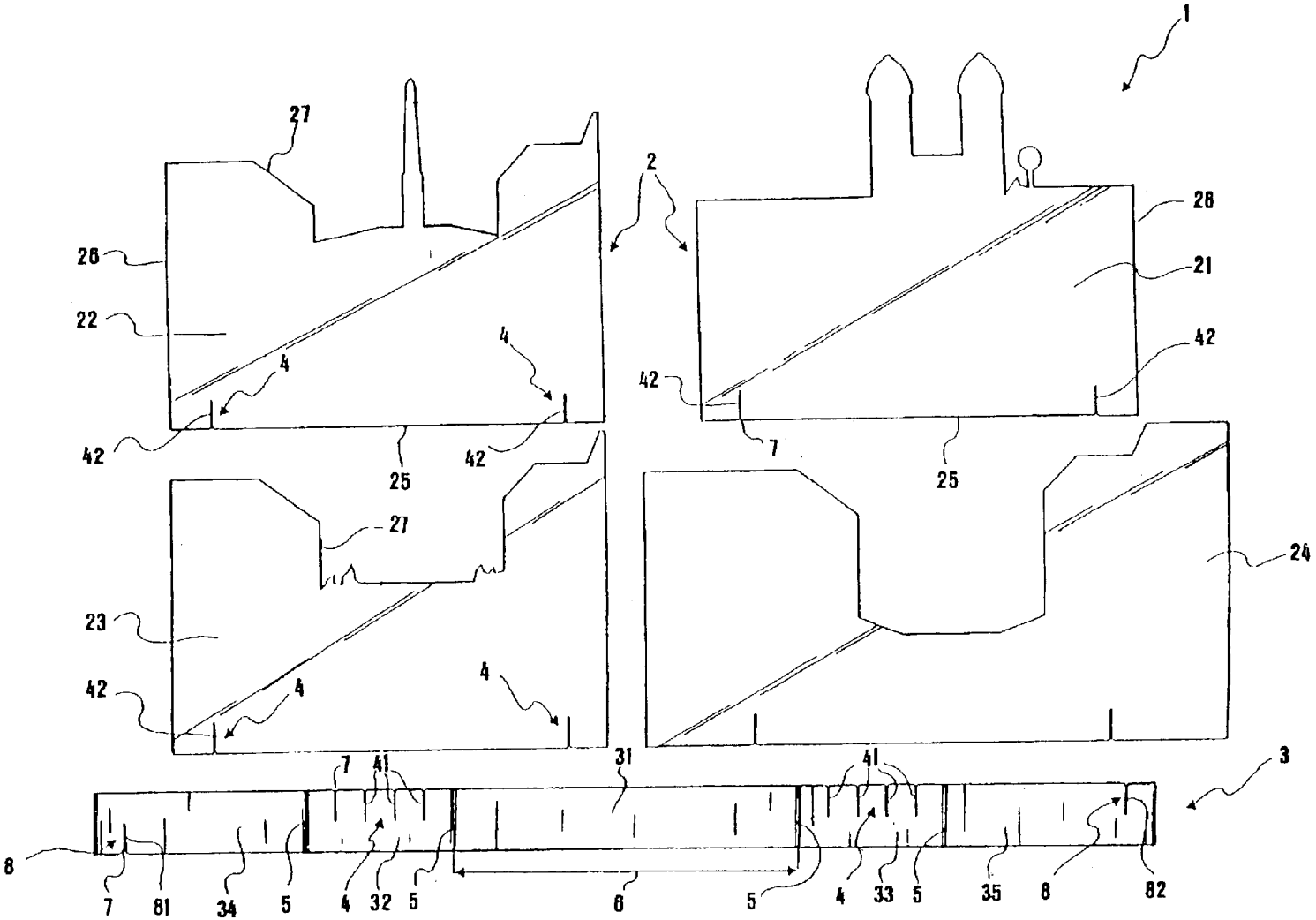
FIG. 1 shows a front view of the set for the composition of bi-dimensional images in tri-dimensional form according to the present invention in a disassembled condition.

By referring to FIG. 1, a set for the composition of bi-dimensional images in tri-dimensional form, denoted with 1 as a whole, comprises a plurality of panels, designated with 2. Each panel of this plurality 2 reproduces one of the above mentioned bi-dimensional images.

The set 1 further comprises a support unit 3, represented in FIG. 1 in a fully disassembled condition, to support the above mentioned panels so that they are substantially parallel to a same plane. The support unit 3 has members rotatably connected one to the other by rotatable connection means, to make the set 1 assume a plurality of configurations, as it will be explained in greater detail hereinafter.

The panels and the support unit 3 of the set 1 also comprise reversible means of mutual engagement, designated with 4 as a whole.

Each of the above mentioned components of the set 1 will be now described in greater detail.

By still referring to the FIG. 1, in the present embodiment the above mentioned panel plurality 2 provides four panels, and precisely a first panel 21, a second panel 22, a third panel 23 and a fourth panel 24. These panels have a thickness considerably smaller than their front dimensions, by then resulting substantially flat. In a front view, each of these four panels has a lower edge 25 and side edges 26 with substantially rectilinear profile. Each panel has furthermore upper edges producing instead a shaped profile 27. This shaped profile 27 follows, for each panel, the contours of figures belonging to the bi-dimensional image reproduced on the panel itself.

Of course, according to variants of the present embodiment, also the side and/or lower edges of the panels could follow the contours of figures of the respective bi-dimensional images.

It will be understood that the range of the possible choices for the above mentioned bi-dimensional images is very wide. For example, they could consist in parts of a view of an architectural structure such as a church or a square, or in parts of a picture reproduction. In the present embodiment, these bi-dimensional images refer to a view of a famous Italian architectural structure. In particular, in this example all the panels reproduce partially or integrally a single starting bi-dimensional drawing, according to modes which will be illustrated in detail hereinafter, by referring to the assembling modes of the set according to the invention.

In the present embodiment, furthermore, the support unit 3 is implemented starting from a substantially strip-like shaped plane blank, designated too with 3 and represented in FIG. 1. From this disassembled condition of FIG. 1, the support unit 3 can be brought to an assembled condition, to which FIGS. 2A and 2B refer, wherein it assumes a frame-like shape.

The blank 3, as already the panels, has a reduced thickness compared to its own front dimensions.

Figures 2A, 2B:
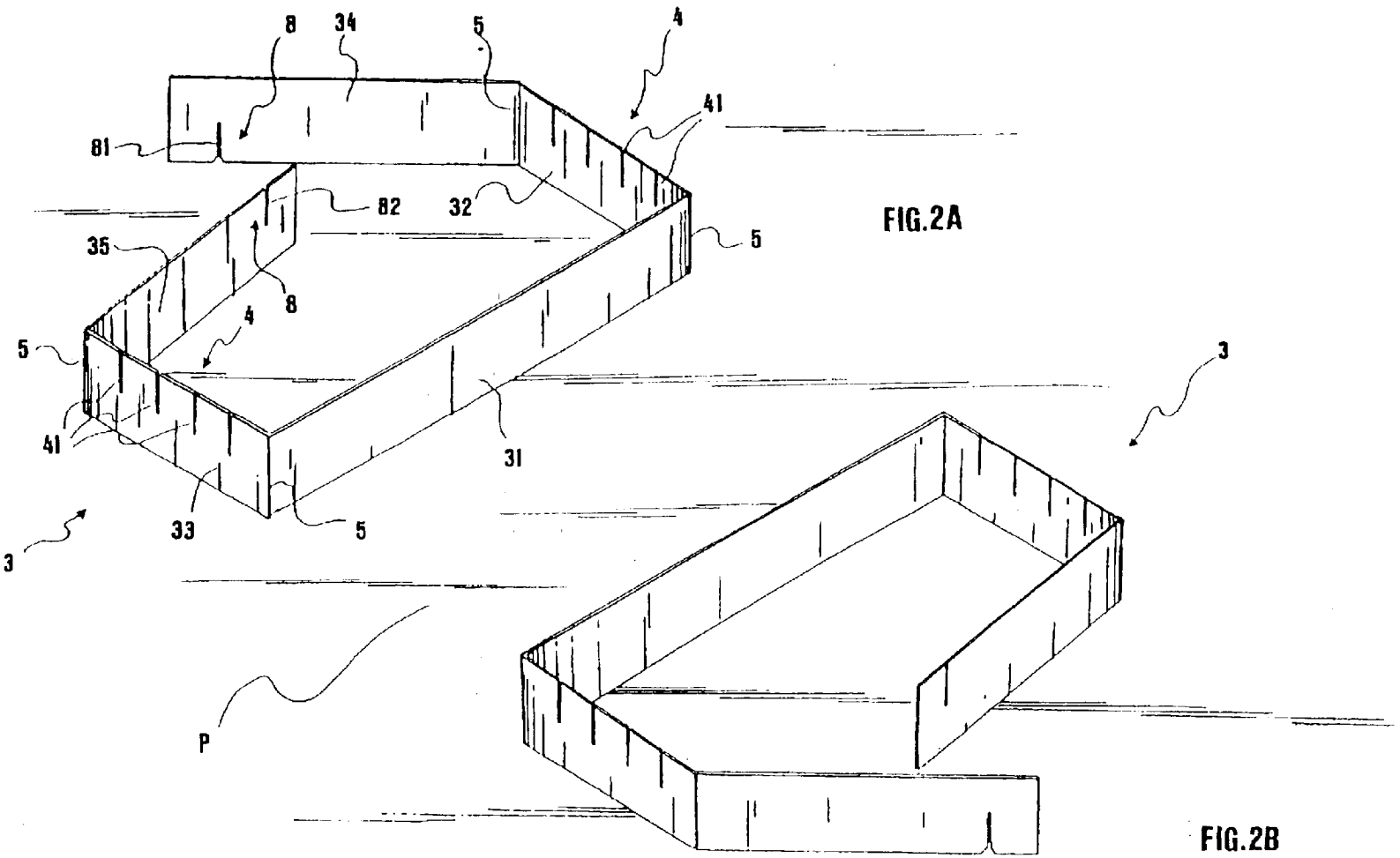
FIGS. 2A and 2B refer to a particular of the set of FIG. 1 in a condition of partial assembling, showing a perspective view, front view and rear view thereof respectively.

By referring both to FIG. 1 and FIGS. 2A and 2B, the blank 3 is made of five members, each apt to produce a wall of the support unit 3 in the assembled condition. For ease of description, the above mentioned five members will be referred to anyway as walls, independently from the assembled or disassembled condition of the support unit 3. The support unit 3 therefore comprises: a front wall 31, which has a longitudinal dimension designated with 6 in FIG. 1; a first side wall 32; a second side wall 33, identical to the first side wall 32; a first rear half-wall 34; and a second rear half-wall 35, apt to co-operate with the first rear half-wall 34 to produce a single rear wall.

Preferably, the front wall 31 will be pre-set to be affixed with a writing, stating for example the subject of the tri-dimensional image shown by the set 1.

Adjacent walls of blank 3 are separated by cross creasings, designated too with 5, which implement the above mentioned rotatable connection means 5 between the members of the support unit 3. In the assembled condition, the blank 3 in fact has been folded at the creasings 5, so as to make the walls thereof rotate one with respect to the other so as to make the support unit 3 assume the above mentioned frame-like shape.

In the present embodiment, the above mentioned reversible means of mutual engagement 4 of the support unit 3 and of the panels comprises first pairs of notches, 41 obtained on the support unit 3, each apt to receive the lower edge 25 of a panel of the above mentioned panel plurality 2. The notches 41 of these first pairs will be designated hereinafter as first notches 41. In each of these first pairs, each notch is obtained at an upper edge of a respective side wall 32, 33 of the support unit 3. Furthermore, the first notches 41 obtained on the first side wall 32 and the first notches 41 obtained on the second side wall 33 are placed according to a same pitch. Therefore, the two notches 41 of each first pair are always aligned on a common plane, substantially parallel to the front wall 31 of the support unit 3, independently from the configuration of the set 1. This will be more evident when the assembling modes of the set 1 itself will be illustrated.

From what has been above illustrated, it will be evident that each of the first pairs of notches 41 co-operates with the lower edge 25 of a panel to support this panel in an erect position. Naturally, the thickness of the blank 3 will be compatible with the above mentioned reception within each first pair of notches 41 of the lower edge 25 of a panel of the panel plurality 2.

In the present embodiment four first pairs of notches 41 are provided, spaced among them according to a constant pitch. Naturally, variants of the present embodiment could provide a variable pitch, to obtain particular perspective effects.

In the present embodiment the reversible means of mutual engagement 4 of the support unit 3 and of the panels furthermore comprises second pairs of notches 42, each one obtained on a panel of the panel plurality 2 and apt to cooperate with the side walls 32, 33 of the support unit 3. The notches 42 of these second pairs will be designated hereinafter as second notches 42. The two notches 42 of each second pair of notches are obtained at the lower edge 25 of a corresponding panel, at a mutual distance equal to the longitudinal dimension 6 of the front wall 31 of the support unit 3. Each of these two second notches 42 of a pair is apt to co-operate with a respective side wall 32, 33 of the support unit 3 to support the panel in an erect position.

In the present embodiment example the support unit 3 has furthermore, at the above mentioned first and second rear half-wall 34, 35, means for closing, designated with 8 as a whole. These means for closing 8 are used to connect the rear half-walls 34, 35 one to the other, so that they produce a single rear wall with a longitudinal dimension equal to the longitudinal dimension 6 of the front wall 31. By means of these means for closing 8, then, the carton blank 3 is closed on itself assuming the above mentioned frame-like shape.

In the present embodiment, the means for closing 8 are implemented as two third notches 81, 82. In particular, a third lower notch 81 is obtained at a lower edge of the first rear half-wall 34, and a third upper notch 82 is obtained at an upper edge of the second rear half-wall 35. The third lower notch 81 is apt to receive the second rear half-wall 35 at the third upper notch 82. The closing modes will be illustrated in greater detail hereinafter.

Advantageously, the first notches 41 will have, at the upper edge of the relative side wall 33, 34, rounded corners, designated with 7 in FIG. 1. This rounding-off produces an invitation to receive the lower edge 25 of a panel. Naturally, similar rounding-offs could be present also on the lower edge 25 of the panels and on the rear half-walls 34, 35 of the support unit 3 at, respectively, second notches 42 and third notches 81, 82.

Preferably, as already the support unit 3, also the panels will be made of paper material, for example, paper, carton or board of conventional basic weight. Alternatively, in order to obtain a greater resistance, the panels and/or the support unit 3 could be made of plastic and/or wood. In this case, the rotatable connection means 5 will be constituted, for example, of conventional-type hinges.

Figure 3:
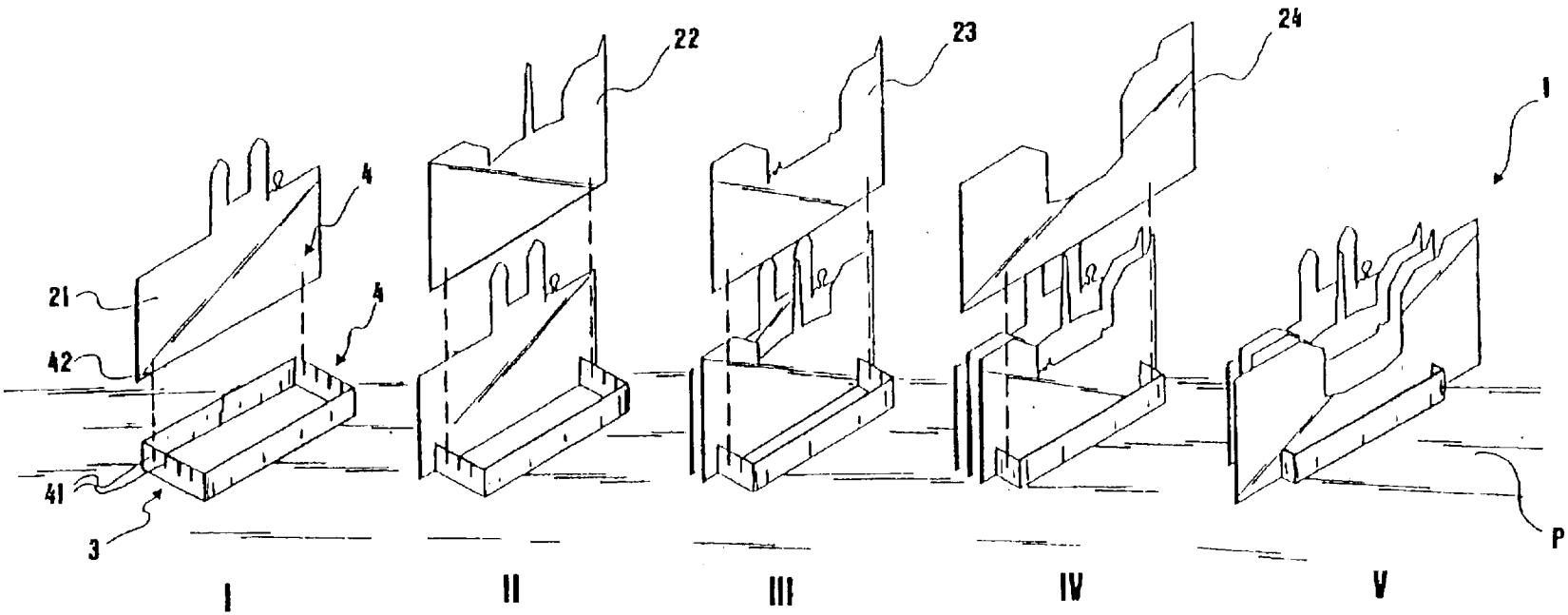
FIG. 3 refers to an assembling sequence of the set of FIG. 1, showing perspective views thereof.

The assembling modes of the set according to the invention will be now described in greater detail by referring to the FIGS. 2A and 3.

By referring to FIG. 2A, before the panels are connected to the support unit 3, the first rear half-wall 34 is connected to the second rear half-wall 35 by the means for closing 8. In particular, the first rear half-wall 34 is inserted, at the third lower notch 81 thereof, in the third upper notch 82 of the second rear half-wall 35, until the grooves of these third notches 81, 82 abut one onto the other.

In this way, the support unit 3 assumes the above mentioned frame-like shape, and it is apt to delimit inside it a substantially parallelepiped-shaped space. Thanks to this shape, the support unit 3 can therefore be rested on a resting plane P and self-support. In particular, the cooperation of the third lower notch 81 and the third upper notch 82 with, respectively, the second rear half-wall 35 and the first rear half-wall 34, prevents any relative movement between these half-walls in a direction parallel to the resting plane P.

By virtue of the rotatable connection means 5, in the assembled condition the support unit 3 produces a so-called "articulated quadrilateral" mechanism. This support unit 3 therefore can be deformed by relative rotations of the adjacent walls thereof at the creasings 5.

By now referring to the FIG. 3, in a first assembling step of the panels, designated with I, the first panel 21 is inserted into one of the above mentioned first pair of notches 41 of the support unit 3 at the lower edge 25 thereof. In particular, each first notch 41 of this first pair of notches receives the first panel 21 at a second notch 42 of the second pair of notches obtained on the panel itself. The first panel 21 is inserted into the support base 3 until the grooves of the above mentioned first notches 41 and second notches 42 abut ones onto the others.

The presence of first notches 41 inhibits any movement in a direction parallel to the side walls 32, 33 of the panels with respect to the support base 3. Similarly, the presence of the second notches 42 inhibits any movement in a direction parallel to the front wall 31 of the panels with respect to the support base 3. Therefore, the panels are locked in the support unit 3 with respect to movements parallel to the resting plane P, and can be extracted from this base according to a direction orthogonal to the resting plane P.

The above mentioned rounding-off of the notch corners simplifies the insertion of the panel into the first notches 41 of the support unit 3 and of the second notches 42 into the side walls 32, 33 thereof. This rounding-off, furthermore, avoids that the support base 3 or the panel damage during this insertion.

As already said, the first notches 41 of a pair are arranged so as to be always aligned on a same plane parallel to the front wall 31. Therefore, when the first panel 21 has been connected to the support base 3 (step designated with II in FIG. 3), this panel is supported in erect position, substantially parallel to the front wall 31.

In the following steps III, IV and V of the panel assembling, the second, third and fourth panel, respectively 22, 23 and 24, are inserted in respective first pair of notches 41 at the second notches 42 thereof, according to modes already illustrated by referring to the first panel 21.
In particular, in the step designated with V the set 1 is shown in a fully assembled condition. In this assembled condition, the bi-dimensional images of the panels form a tri-dimensional image for an observer looking at the set 1.

At this point it is useful to further dwell upon the implementation modes of the bi-dimensional images shown by the panels of the panel plurality 2. As already said, in the present embodiment a single starting bi-dimensional drawing has been reproduced in a number of copies equal to the number of panels of this plurality, namely four. Therefore, from each of these four copies a portion of said drawing has been cut out, to produce a respective panel. Not necessarily the above mentioned portions reproduce parts all distinct among them of the initial bi-dimensional drawing, on the contrary drawing parts reproduced on more than one panel could be present. In this case, when the panels are connected to the support unit 3, the parts of the initial bi-dimensional drawing reproduced on more than one panel will be generally visible only on the panel placed more frontally among those showing the part of the drawing at issue.

Therefore, in the assembled condition of the set 1, the starting bi-dimensional drawing is composed again in tri-dimensional form.

The just described mode to compose into tri-dimensional form a single starting bi-dimensional drawing considerably simplifies the implementation modes of the set according to the invention.

Naturally, alternative embodiments provide instead that, on the panels of the panel plurality, bi-dimensional images, all distinct and not necessarily originated by a single bi-dimensional drawing, are reproduced. These alternative embodiments allow increasing the range of views and the variety of tri-dimensional images which can be generated with the set according to the invention.

Figure 4:
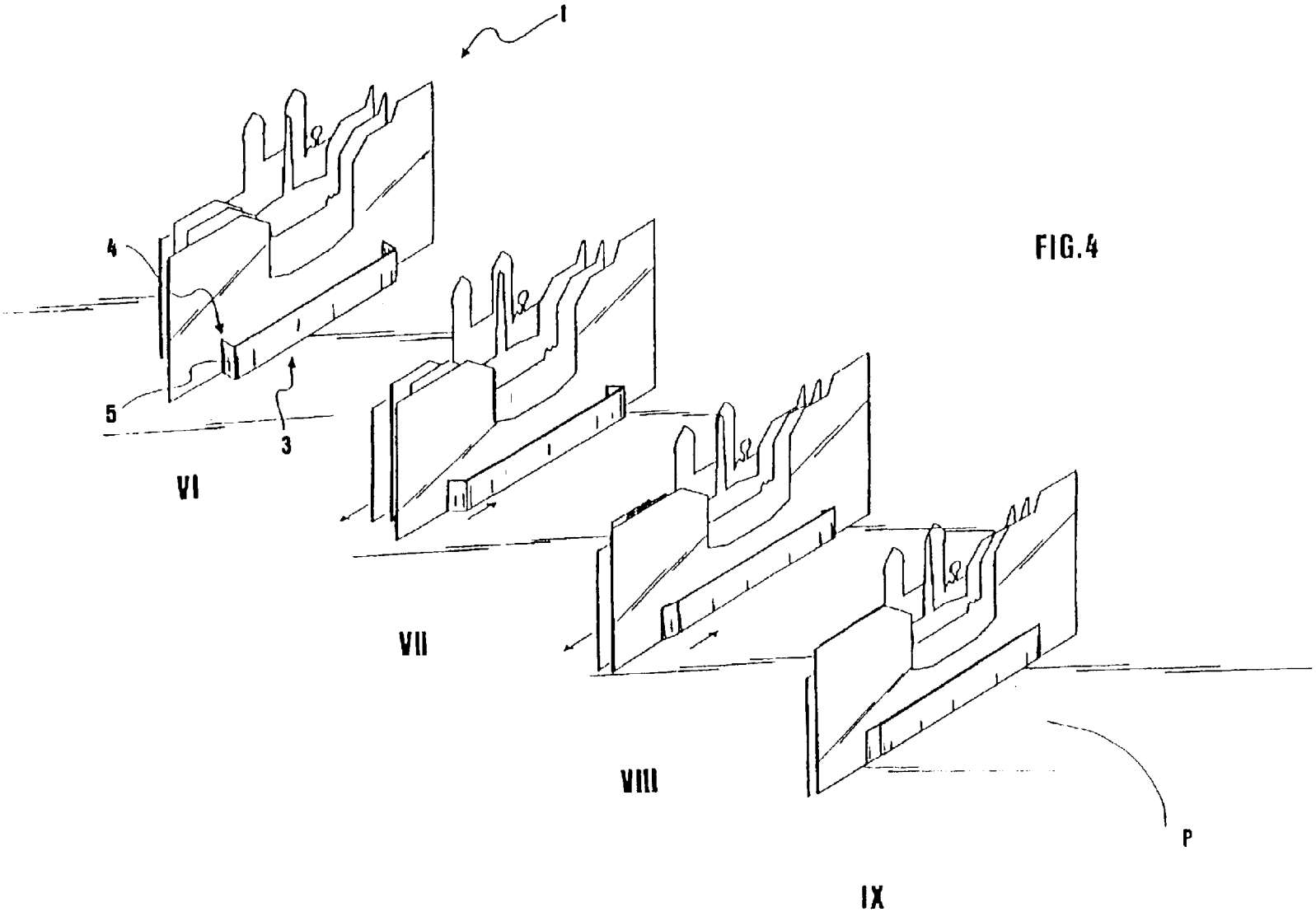
FIG. 4 refers to different configurations of the set of FIG. 1, showing perspective views thereof.

FIG. 4 will be now referred to, showing some of the configurations that the set 1 can assume once assembled.

The mutual engagement, according to the above mentioned modes, of the panels and of the support unit 3 does not alter the possibility of changing the configuration of the set 1 by deforming the support base 3 at the creasings 5 thereof. In particular, thanks to the above mentioned arrangement wherein the panels are parallel to a same plane, the whole set 1 can move as an articulated quadrilateral.

Therefore, by seizing the support unit 3 and compressing the structure thereof, a change in the arrangement of the walls thereof could be produced, by means of relative rotations of adjacent walls. These rotations naturally determine a change of the angle between the adjacent walls themselves. In particular, the relative angles between each side wall 32, 33 and the front 31 and rear walls will change. According to motion properties of an articulated quadrilateral, the front walls 32, 33 will keep anyway always parallel one to the other. Furthermore, the front wall 31 and the rear wall will remain always parallel to a same plane, parallel too to the panels.

By virtue of the above mentioned rotations, also the mutual arrangement of the panels and the distance between adjacent panels will change. In particular, during these rotations an observer placed in front of the set 1 will see the panels translate one with respect to the other. Following this translation, the parts of the bi-dimensional image reproduced on each panel which are visible to the observer will change. In the same way, also the angle according to which the images themselves are seen will change.

Therefore, the deformations of the support unit 3 produced as above described allow the set 1 to assume a plurality of configurations. To each of these configurations, a certain mutual arrangement of the panels and a certain distance between adjacent panels, and, therefore, a different perspective effect will correspond.

The configurations providing that the panels be spaced one from the other could be called exhibition configurations, since in these configurations the set 1 has substantially tri-dimensional extension. For example, the set 1 could assume any exhibition configuration designated with VI, VII and VIII in FIG. 4. In particular, in the configuration designated with VI the side walls 32, 33 are orthogonal to the front 31 and rear walls, and the distance between the panels is therefore maximal. Starting from this configuration, the support base 3 can be deformed as shown by the arrows, to produce the configurations designated with VII and VIII.

To the plurality of exhibition configurations which the set 1 can assume, as many tri-dimensional views and perspectives correspond, generated starting from the bi-dimensional images reproduced on the panels. In particular, a user could generate at will a very wide range of perspective effects.

Then, by making the adjacent walls of the support unit 3 to rotate until the panels and the walls come in mutual contact and all the walls are substantially parallel to a same plane, a configuration with minimal encumbrance is obtained, designated with IX in FIG. 4. In this configuration with minimal encumbrance the set 1 has substantially plane extension.

At this point, it is worth noting that, according to variants of the here described embodiment, the reversible means of mutual engagement can provide only the cooperation of the first notches 41 of the support unit 3 with the lower edges 25 of the panels, or only the cooperation of the second notches 42 of the panels with the side walls 32, 33 of the support unit 3. Reversible means of this type will produce a sliding connection between panels and support unit 3 in a direction parallel to the resting plane P.

If only cooperation of the first pairs of notches 41 with the lower edges 25 of the panels is provided, the reversible means of mutual engagement will inhibit exclusively the displacements of the panels along the side walls of the support unit 3, that is bringing-near—moving-away displacements between adjacent panels, but not displacements of the panels parallel to the front wall 31.

On the contrary, if only cooperation of the second notches 42 with the side walls 32, 33 is provided, the reversible means of mutual engagement will inhibit exclusively the displacements in direction parallel to the front wall, whereas the panels could slide along the side walls.

In both the above described cases, the number of possible exhibition configurations of the set according to the invention increases to a great extent and, consequently, the range of perspective effects obtainable with a same number of panels broadens. However, if only the second notches 42 in cooperation with the side walls 32, 33 are provided, upon assembling it will be necessary to pay attention to arrange the panels according to planes parallel to the front wall 31, in order not to inhibit the rotating motions around the creasings 5 of the support unit 3.

Still in order to provide to the user a wider range of visive solutions, the panel plurality 2 could comprise a number of panels higher than the number of first pairs of notches 41 provided on the support unit 3, or anyway higher than the number of panels connectable contemporarily to the latter.

Furthermore, in order to support the panels in erect position it is not necessary that the support unit 3 comprise the above mentioned rear halfwalls 34, 35 and the relative means for closing 8. The support unit 3 in fact could only have the front wall and the two side walls 33, 34. In assembled condition, therefore, it would assume a substantially "C"-like shape. Naturally, the presence of the rear wall increases the stability of the set 1.

According to another embodiment variant, the support unit can provide intermediate reinforcement members, placed parallel to the side walls and/or to the front and rear walls and rotatably connected thereto, to form a kind of grid inside the above mentioned walls.

Figure 5:
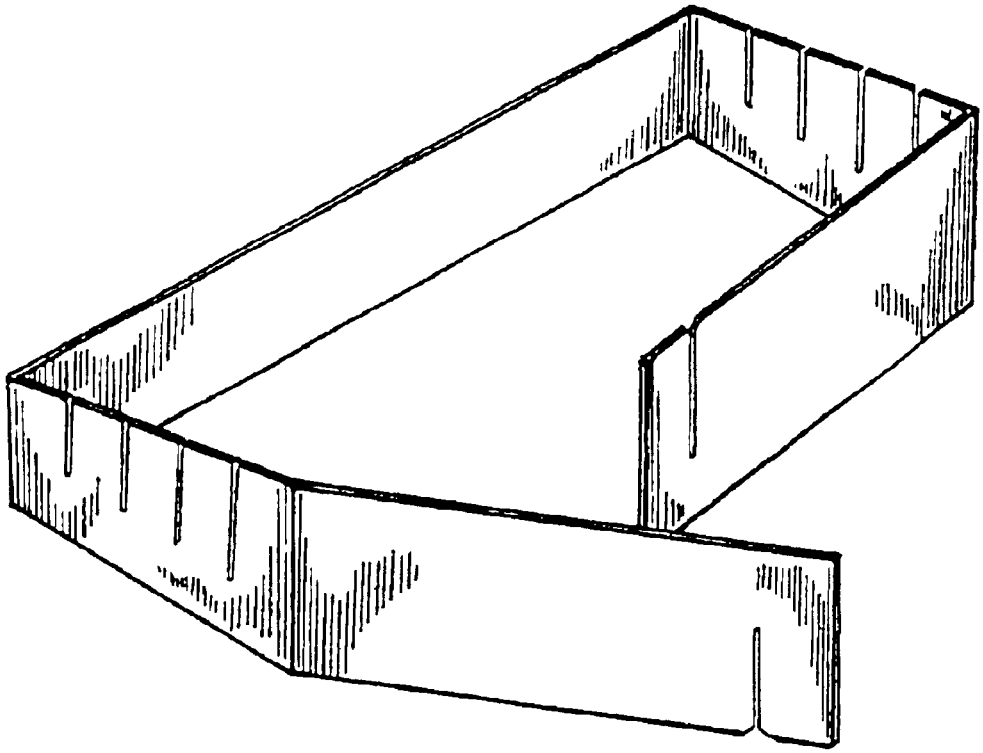
FIG. 5 shows a variant embodiment of the invention.

Still to guarantee a better support of the panels, the walls of the support unit could have shapes different from the ones shown in the present Figures. For example, if the panels to be placed frontally or in the back were particularly higher or heavier than the others, at least one of the side walls could have a trapezoidal profile, to provide greater support to the above mentioned panels (FIG. 5).

At this point it will be appreciated that the set according to the invention has other important advantages apart from the already mentioned ones. In particular, it will be appreciated that the set is extremely simple to implement. Even already the blank model provided in FIG. 1 would enable to construct the set itself. In fact, it can be implemented starting from a single sheet of paper with conventional format, for example an A4-format.

The set according to the invention furthermore can be assembled very easily and, if needed, it can be easily folded in its configuration with minimal encumbrance. This latter configuration is also particularly suitable for packaging.

Moreover, obtaining different perspective effects is extremely easy, since it is simply necessary to deform the support unit, even with one hand.

All the above mentioned features and advantages make the set according to the present invention particularly apt to implement games for children, or when one wants to evaluate in advance the aesthetical effect of several design solutions.

The present invention has been sofar described by mainly referring to a preferred embodiment. It is to be meant that this preferred embodiment may be subject to variants belonging to the same inventive core, all however comprised within the protective scope of the herebelow reported claims.

What is claimed is:

1. A set for the composition of bi-dimensional images in tri-dimensional form, comprising:

a plurality of panels each panel of said panel plurality reproducing a respective bi-dimension image; and a support unit, apt to support the panels of said panel plurality so as they are substantially parallel to a same plane, said support unit having members rotatably connected one to the other by rotatable connection means, to make said set assume a plurality of exhibition configurations, wherein said set has substantially tri-dimensional extension, and a minimal encumbrance configuration, wherein said set has substantially plane extension, wherein the panels of said panel plurality and said support unit have reversible means of mutual engagement and wherein said members of said support unit comprise a front wall, a first side wall, a second side wall and a rear wall, said support unit being apt to assume a closed frame-like shape said rear wall comprising a first rear halfwall, a second rear halfwall and means apt to reversibly closing said first and second halfwall.

2. The set according to claim 1, wherein said reversible means of mutual engagement comprises pairs of notches.

3. The set according to claim 2, wherein said reversible means of mutual engagement comprises first pairs of notches obtained on said support unit, each of said first pairs of notches being apt to receive a respective panel of said plurality of panels at a lower edge of said panel, each notch of said each pair being obtained on a respective first or second side wall at an upper edge thereof.

4. The set according to claim 3, wherein the two notches of said each pair are obtained on said first and second side wall according to an arrangement wherein said notches are aligned on a common plane, substantially parallel to said front wall.

5. The set according to claim 3, wherein said first pairs of notches are arranged on said support unit according to a constant pitch.

6. The set according to claim 3, wherein said reversible means of mutual engagement comprises second pairs of notches, each one obtained on a respective panel of said panel plurality at a lower edge of said panel, each notch of said each pair being apt to co operate with a respective first or Second side wall of said support unit.

7. The set according claim 3, where said notches have rounded corners.

8. The set according to claim 1, wherein at least one of said first and second side wall has a trapezoidal profile.

9. The set according to claim 1, wherein said means for closing comprises two third notches each one obtained on a respective first or second rear halfwall and apt to cooperate with the other rear halfwall for closing said support unit into a frame-like shape.

10. The set according to claim 1, wherein said support unit is obtained starting from a plane carton blank substantially strip-like shaped, and wherein said rotatable connection means comprises cross creasings of said blank.

11. The set according to claim 1, wherein said panels of said panel plurality partially or wholly reproduce a single starting bi-dimensional drawing.

12. The set according to claim 1, wherein said panels of said panel plurality and said support unit are made of paper material.

13. The set according to claim 1, wherein said panels of said panel plurality and said support unit are made of plastic or wood.

* * * * *